US006430387B1

(12) United States Patent
Quesnel et al.

(10) Patent No.: US 6,430,387 B1
(45) Date of Patent: Aug. 6, 2002

(54) ELECTROSTATOGRAPHIC REPRODUCTION MACHINE HAVING A MOTION-DEFECT-FREE CLEANING METHOD AND ASSEMBLY

(75) Inventors: Lisbeth S. Quesnel, Pittsford; Norman E. LaTour, Rochester; Nicholas M. Soures, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/742,203

(22) Filed: Dec. 20, 2000

(51) Int. Cl.[7] ..... G03G 21/00
(52) U.S. Cl. ..... 399/345; 399/353
(58) Field of Search ..... 399/345, 353

(56) References Cited

U.S. PATENT DOCUMENTS 5,669,055 A * 9/1997 Thayer et al. ..... 399/345
5,930,575 A * 7/1999 Fornalik et al. ..... 399/345

* cited by examiner

*Primary Examiner*—William J. Royer
(74) *Attorney, Agent, or Firm*—Tallam I. Nguti

(57) ABSTRACT

A motion-defect-free assembly and a method of minimizing cleaning apparatus induced motion quality disturbances in a moving belt photoreceptor of a toner image reproduction machine are provided. The assembly for practicing the method includes at least one resilient member located to each side of the moving belt photoreceptor at a desired belt cleaning station along a path of movement of the belt photoreceptor, and a cleaning apparatus that is mounted at the cleaning station and that includes at least one separately moveable cleaning member. The cleaning apparatus also includes a moveable frame having frame locating members, and the at least one separately moveable cleaning member. The motion-defect-free assembly also includes a drive and control system for first moving the moveable frame into contact with each of the locating members and for then separately moving, relative to the moveable frame, the at least one separately moveable cleaning member into contact and cleaning engagement with the moving belt photoreceptor, thereby minimizing cleaning apparatus induced motion quality disturbances in the moving belt photoreceptor.

10 Claims, 3 Drawing Sheets

ELECTROSTATOGRAPHIC REPRODUCTION MACHINE HAVING A MOTION-DEFECT-FREE CLEANING METHOD AND ASSEMBLY

BACKGROUND OF THE INVENTION

This invention relates generally to electrostatographic image reproduction machines, and more particularly concerns an electrostatographic reproduction machine having a motion-defect-free cleaning method and assembly for preventing motion related image defects.

In an electrostatographic image reproduction machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in irradiated areas. This records an electrostatic latent image on the photoconductive member corresponding to the informational areas contained within the original document being reproduced.

After the electrostatic latent image is recorded on the photoconductive member, the latent image is developed by bringing developer material containing charged toner particles, for example, black toner particles, into contact therewith. Developer material can be single component comprised only of charged toner particles, or it may be dual component comprising carrier particles and toner particles that are triboelectrically charged when admixed or mixed with the carrier particles. In either case, bringing the developer material into contact with the latent image forms a toner image on the photoconductive member which is subsequently transferred to a copy sheet. The copy sheet is then separated from the photoconductive member and the toner powder is fed on the copy sheet through a fusing apparatus where it is heated to permanently affix it to the copy sheet, thus forming a black and white copy of the original document.

Multi-color electrostatographic image reproduction machines which use multi-colored toners are substantially identical in each color image forming process to the foregoing process of black and white image reproduction which uses only black toner. However, rather than forming a single latent image on the photoconductive member, several single color latent images corresponding to color separated light images of the original document are recorded thereon. Each single color electrostatic latent image is developed with toner particles of a color complementary thereto. This process may be performed in a single pass of the photoconductive member, or in multipasses thereof during which image formation is repeated over a plurality of cycles, for forming different colored images using their respective complementarily colored toner particles. Each single color toner powder image is thus formed on the photoconductive member in superimposed registration with the other toner powder images.

This creates a composite multi-layered toner powder image which is then transferred directly, or via an intermediate transfer member, onto a copy sheet. The copy sheet is then separated from the photoconductive member or from the intermediate transfer member and fed through a fusing apparatus for permanently affixing the toner image to the copy sheet. This creates a hard color copy of the original multi-color document.

In multipass multi-color image reproduction machines which have a photoconductive belt member, it is necessary for the cleaning system therein to be capable of engaging the photoconductive member to clean, as well as, retracting from the photoconductive member in order to allow image formation. In order to sustain a desired machine output rate, it is also necessary for the cleaning system to be accurately locatable "on the fly".

Unfortunately, there is a major problem that results from motion quality disturbances as a retracted cleaner re-engages the photoconductive member "on the fly". It has been found that conventional cleaning systems, such as brush cleaners with supporting frames that directly contact a photoconductor assembly itself, ordinarily cannot be located accurately for cleaning without the motion of such frames having an undesirable impact on the photoconductive member or photoreceptor, and thereby causing motion related defects or image disturbance defects. Conventional attempts to reduce such impact by reducing the speed of the cleaning housing or frame at contact, ordinarily result in unacceptably high levels of impact force.

There is therefore a need for a cleaning system that will solve such motion quality impact problems.

SUMMARY OF THE INVENTION

In accordance with one aspect of the present invention, there is provided a motion-defect-free method of minimizing cleaning apparatus induced motion quality disturbances in a moving belt photoreceptor of a toner image reproduction. The method includes the steps of providing at least one resilient member to each side of the moving belt photoreceptor and at a desired belt cleaning station along a path of movement of the belt photoreceptor, and mounting a cleaning apparatus that includes a moveable frame having frame locating members, and at least one separately moveable cleaning member at the cleaning station. The motion-defect-free method also includes the steps of first moving the moveable frame into contact with each of the locating members, and for then separately moving, relative to the moveable frame, the at least one separately moveable cleaning member, into contact and cleaning engagement with the moving belt photoreceptor, thereby minimizing cleaning apparatus induced motion quality disturbances in the moving belt photoreceptor.

In accordance with another aspect of the present invention, there is provided a motion-defect-free cleaning assembly for minimizing cleaning apparatus induced motion quality disturbances in a moving belt photoreceptor of a toner image reproduction. The assembly includes at least one resilient member located to each side of the moving belt photoreceptor at a desired belt cleaning station along a path of movement of the belt photoreceptor, and a cleaning apparatus that is mounted at the cleaning station and that includes at least one separately moveable cleaning member and a moveable frame having frame locating members. The motion-defect-free assembly also includes a drive and control system for first moving the moveable frame into contact with each of the locating members and for then separately moving, relative to the moveable frame, the at least one separately moveable cleaning member into contact and cleaning engagement with the moving belt photoreceptor, thereby minimizing cleaning apparatus induced motion quality disturbances in the moving belt photoreceptor.

BRIEF DESCRIPTION OF THE DRAWINGS

In the detailed description of the invention presented below, reference is made to drawings, in which.

DETAILED DESCRIPTION OF THE INVENTION

Figure 1:
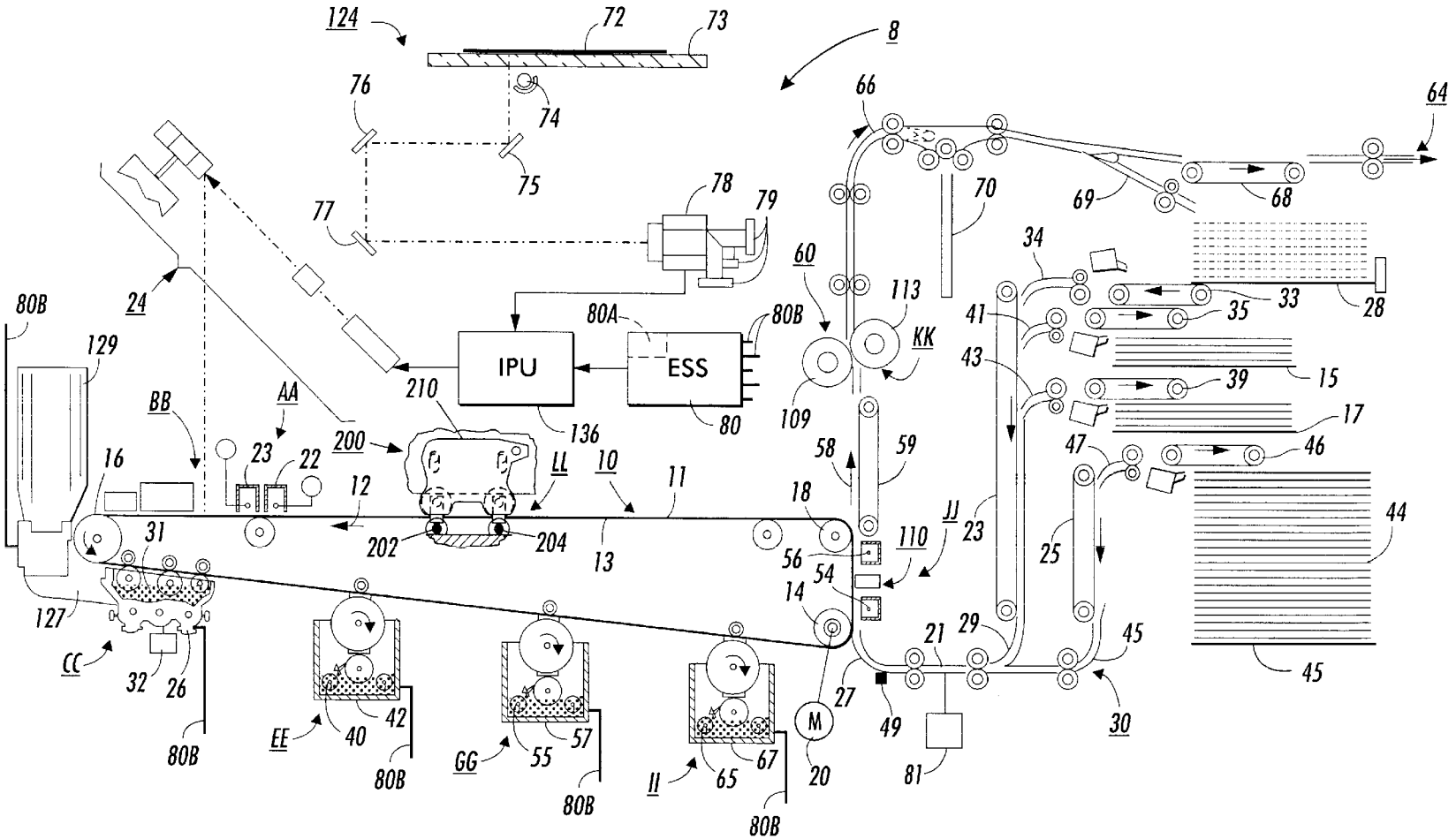
FIG. 1 is a schematic illustration of an exemplary electrostatographic reproduction machine incorporating a dual mode development unit operating time control apparatus and method in accordance with the present invention.

For a general understanding of the features of the present invention, reference is made to the drawings, wherein like reference numerals have been used throughout to identify the same or similar elements. On the contrary, the following description is intended to cover all alternatives, modifications, and equivalents, as may be included within the spirit and scope of the invention as defined by the appended claims.

Referring to FIG. 1, there is depicted an exemplary electrostatographic reproduction machine, such as a multipass color electrostatographic reproduction machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light.

The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the apparatus and method for dual mode control of the operating or "on" time for the development units of the machine 8 (to be described in detail below).

The ESS 80 is preferably a self-contained, dedicated minicomputer having a central processor unit (CPU), electronic storage, and a display or user interface (UI). The ESS is the control system which, with the help of sensors and connections 80B as well as a pixel counter 80A, reads, captures, prepares and manages the image data flow between IPU 136 and scanning assembly 124. In addition, the ESS 80 is the main multi-tasking processor for operating and controlling all of the other machine subsystems and printing operations. These operations include imaging, development, sheet delivery and transfer, and cleaning using the cleaning method and assembly 200 in accordance with the present invention. Such operations also include various functions associated with subsequent finishing processes. Some or all of these subsystems may have micro-controllers that communicate with the ESS 80.

The multipass color electrostatographic reproduction machine 8 employs a photoreceptor 10 in the form of a belt having a photoconductive surface 11 on an electroconductive substrate, and a backside 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially-uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separation image in a series of parallel scan lines having a certain resolution, generally referred to as lines per inch. Scanning device 24 may include a laser with rotating polygon mirror blocks and a suitable modulator, or in lieu-thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer. A special feature of non-interactive development is that adding and admixing can continue even when development is disabled. Therefore the timing algorithm for the adding and admixing function can be independent of that for the development function, as long as admixing is enabled whenever development is required.

These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 8.

Accordingly, different jobs of several documents being reproduced, will cause toner depletion at different rates depending on the sustained, copy sheet area toner coverage level of the images thereof being reproduced. In a machine using two component developer material as here, such depletion undesirably changes the concentration of such particles in the developer material. In order to maintain the concentration of toner particles within the developer material (in an attempt to insure the continued quality of subsequent images), the adding and admixing function of the development unit must be operating or turned "on" for some controlled period of time in order for the device 127 to replenish the development unit 26 with fresh toner particles from a source 129. Such fresh toner particles must then be admixed with the carrier particles in order to properly charge them triboeletrically.

On the second and subsequent passes of the multipass machine 8, the pair of corona generating devices 22 and 23 are employed for recharging and adjusting the voltage level of both the toned (from the previous imaging pass), and untoned areas on photoreceptor 10 to a substantially uniform level. A power supply is coupled to each of the electrodes of corona generating devices 22 and 23. Corona generating devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Scanning device 24 is then used on the second and subsequent passes of the multipass machine 8, to superimpose subsequent latent images of a particular color separation image, by selectively discharging the recharged photoreceptor 10. The operation of scanning device 24 is of course controlled by the controller, ESS 80. One skilled in the art will recognize that those areas developed or previously toned with black toner particles will not be subjected to sufficient light from the scanning device 24 as to discharge the photoreceptor region lying below such black toner particles. However, this is of no concern as there is little likelihood of a need to deposit other colors over the black regions or toned areas.

Thus on a second pass, scanning device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow developer material 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 8, the pair of corona generating devices 22 and 23 are again employed for recharging and readjusting the voltage level of both the toned and untoned areas on photoreceptor 10 to a substantially uniform level. A power supply is coupled to each of the electrodes of corona generating devices 22 and 23. The corona generating devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by scanning device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 8, the pair of corona generating devices 22 and 23 again recharge and adjust the voltage level of both the previously toned and yet untoned areas on photoreceptor 10 to a substantially uniform level. A power supply is coupled to each of the electrodes of corona generating devices 22 and 23. The corona generating devices 22 and 23 substantially eliminate any voltage difference between toned areas and bare untoned areas as well as to reduce the level of residual charge remaining on the previously toned areas. A fourth latent image is then again created using scanning device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown. Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pre-transfer corotron member negatively charges all toner particles to the required negative polarity to ensure proper subsequent transfer.

Since the machine 8 is a multicolor, multipass machine as described above, only one of the plurality of development units, 26, 42, 57 and 67 may have its development function turned "on" and operating during any one of the required number of passes, for a particular color separation image development. The remaining development units must thus have their development functions turned off. As pointed out above and to be addressed below, the conventional approach is to use the same timing for the development function and the adding and admixing function, which causes design and operating conflicts in determining and effecting a control method for the "on" time for each development unit, particularly during sustained high area toner coverage jobs, in order to insure continued reproduction of high quality images without risking a quality or productivity degradation, or customer dissatisfaction.

Still referring to FIG. 1, during the exposure and development of the last color separation image, for example by the fourth development unit 67 a sheet 44 of support material is advanced to a transfer station JJ by a sheet feeding apparatus 30. During simplex operation (single sided copy), a blank sheet 44 may be fed from tray 15 or tray 17, or a high capacity tray 45 thereunder, to a registration transport 21, in communication with controller 81, where the sheet 44 is registered in the process and lateral directions, and for skew position. One skilled in the art will realize that trays 15, 17, and 45 each hold a different sheet type. The speed of the sheet 44 is adjusted at registration transport 21 so that the sheet arrives at transfer station JJ in synchronization with the composite multicolor image on the surface of photoconductive belt 10.

Registration transport 21 receives a sheet 44 from either a vertical transport 23 or a high capacity tray transport 25 and moves the received sheet 44 to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet 44 from trays 15 and 17 to the vertical transport 23 by chutes 41 and 43. The high capacity tray transport 25 receives the sheet 44 from tray 45 and guides it to the registration transport 21 via a lower baffle 45. A sheet feeder 46 advances copy sheets 44 from tray 45 to transport 25 by a chute 47.

The pretransfer baffle 27 guides the sheet 44 from the registration transport 21 to transfer station JJ. Charge limiter 49 located on pretransfer baffle 27 restricts the amount of electrostatic charge a sheet 44 can place on the baffle 27 thereby reducing image quality problems and shock hazards. The charge can be placed on the baffle from either the movement of the sheet 44 through the baffle or by the corona generating devices located at transfer station JJ. When the charge exceeds a threshold limit, charge limiter 49 discharges the excess to ground.

Transfer station JJ includes a transfer corona device 54 which provides positive ions to the backside of the copy sheet 44. This attracts the negatively charged toner powder images from photoreceptor belt 10 to the sheet 44. A detack corona device 56 is provided for facilitating stripping of the sheet 44 from belt 10.

A sheet-to-image registration detector 110 is located in the gap between the transfer and detack corona devices 54 and 56 to sense variations in actual sheet 44 to image registration and provides signals indicative thereof to ESS 80 and controller 81 while the sheet 44 is still tacked to photoreceptor belt 10. After transfer, the sheet 44 continues to move, in the direction of arrow 58, onto a conveyor 59 that advances the sheet 44 to fusing station KK.

Fusing station KK includes a fuser assembly, indicated generally by the reference numeral 60, which permanently fixes the transferred color image to the copy sheet 44. Preferably, fuser assembly 60 comprises a heated fuser roller 109 and a backup or pressure roller 113. The copy sheet 44 passes between fuser roller 109 and backup roller 113 with the toner powder image contacting fuser roller 109. In this manner, the multi-color toner powder image is permanently fixed to the sheet 44. After fusing, chute 66 guides the advancing sheet 44 to feeder 68 for exit to a finishing module (not shown) via output 64. However, for duplex operation, the sheet 44 is reversed in position at inverter 70 and transported to duplex tray 28 via chute 69. Duplex tray 28 temporarily collects sheets 44 whereby sheet feeder 33 then advances it to the vertical transport 23 via chute 34. The sheet 44 fed from duplex tray 28 receives an image on the second side thereof, at transfer station JJ, in the same manner as the image was deposited on the first side thereof. The completed duplex copy exits to the finishing module (not shown) via output 64.

Figure 2:
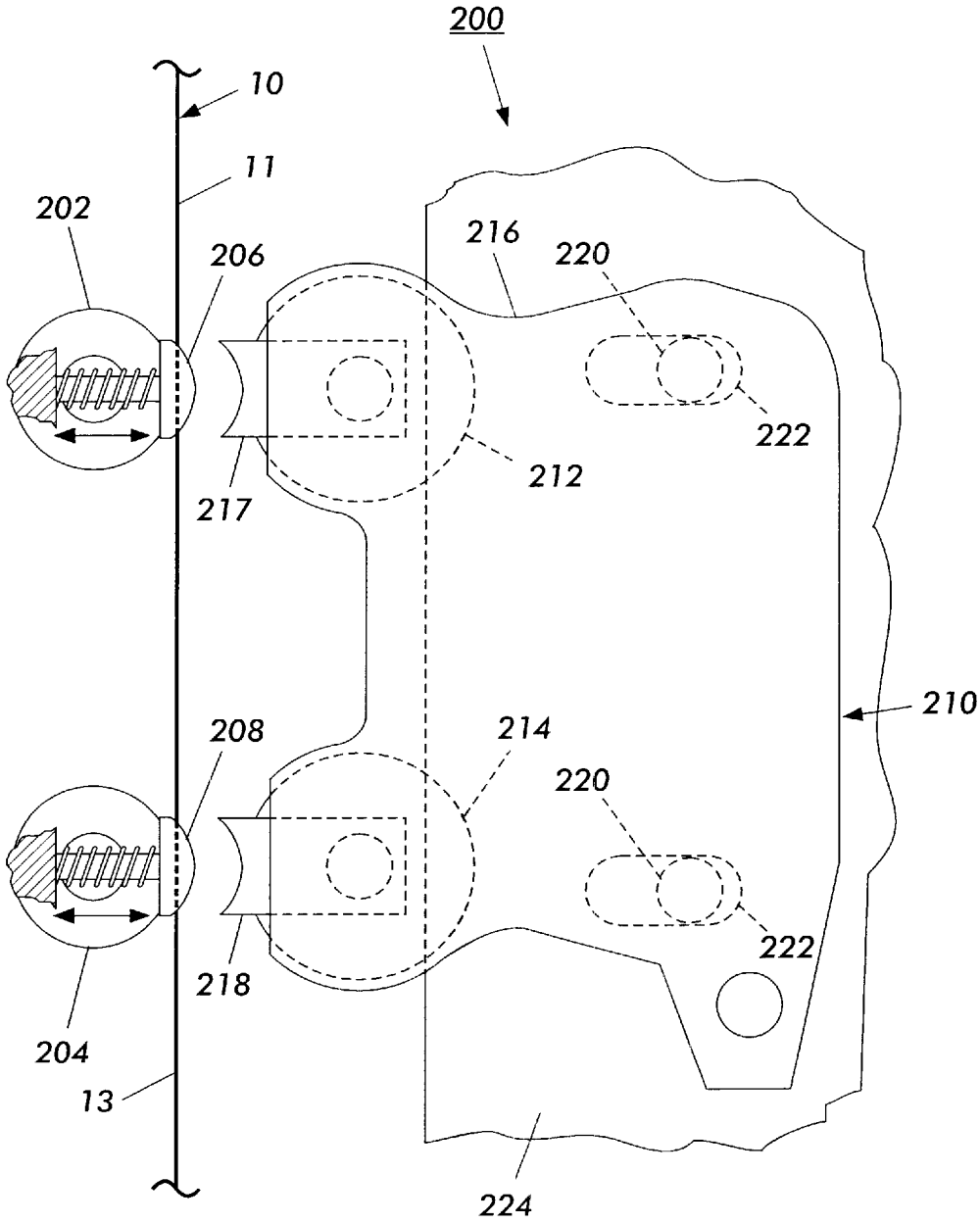
FIG. 2 is a schematic illustration of the motion-defect-free cleaning apparatus of the present invention in a retracted position.
Figure 3:
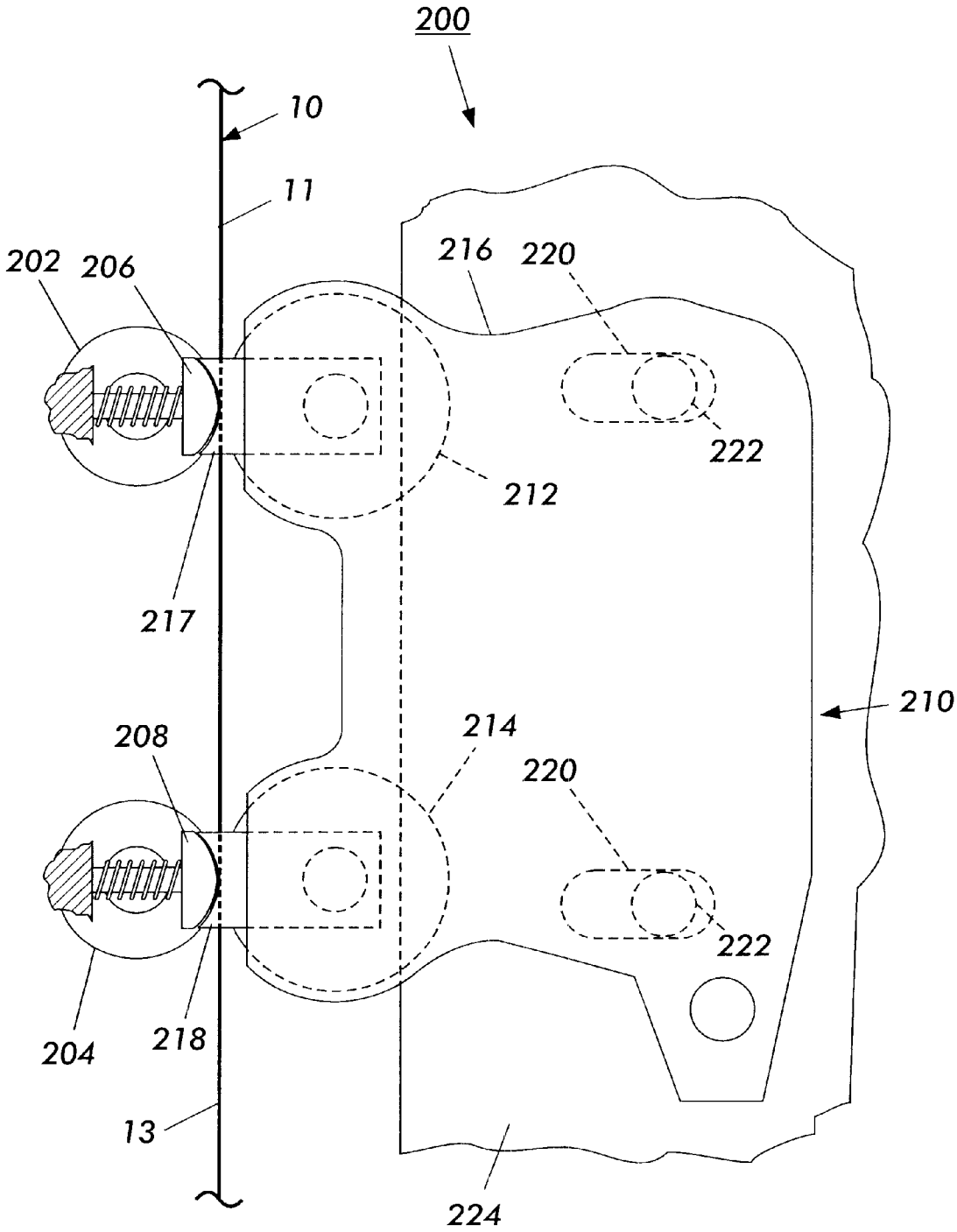
FIG. 3 is a schematic illustration of the motion-defect-free cleaning apparatus of the present invention in an engaged and cleaning position.

Referring now to FIGS. 1–3, the multipass color electrostatographic reproduction machine 8 includes a cleaning station LL where the image bearing or photoreceptor surface 11 of the photoreceptor 10 is cleaned using the motion-defect-free cleaning method and assembly 200 of the present invention. As illustrated in FIG. 1, after the sheet 44 of support material is separated from photoreceptor 10, residual toner particles remaining on the photoreceptor surface are removed in accordance with the present invention, and in preparation for subsequent use.

As discussed in the background, multi-color image reproduction machines, such as the machine 8, which make multiple passes with the photoreceptor 10, ordinarily require the cleaning system therein to be capable of retracting from the photoreceptor during image formation, and engaging the photoreceptor for cleaning. The locational accuracy required from these cleaning systems is such that "on the fly" locating could be employed. However, the resulting motion quality impact on the photoreceptor causes motion related defects or image disturbance defects. In other words, the cleaning system must retract during the multiple passes required for multicolor image formation. It is only after the image is transferred, that the cleaning system re-engages. A major problem which results particularly from the re-engagement, is motion quality disturbances or defects. Such systems and their method are thus not motion-defect-free, particularly where the photoreceptor is in the form of a belt.

To solve this major problem, there is provided in accordance with the present invention, a method of minimizing cleaning apparatus induced motion quality disturbances in a moving belt photoreceptor 10 of a toner image reproduction machine 8. The method includes the steps of (i) providing at a desired belt cleaning station LL along a path of movement of the belt photoreceptor, at least one resilient member 206, 208 to each side of the moving belt photoreceptor; (ii) mounting at the cleaning station LL, a cleaning apparatus 210 that includes at least one separately moveable cleaning member 212, 214, and a moveable frame 216 having frame locating members 217, 218 and supporting the at least one separately moveable cleaning member 212, 214; and (iii) first moving the moveable frame 216 towards the moving belt photoreceptor 10 and towards the at least one resilient member 206, 208. A drive and control system (not shown) including the ESS 80, is used in combination with the other elements of the present invention, for timing, moving and locating the frame and cleaning members of the motion-defect-free cleaning assembly 200 of the present invention.

The method also includes the steps of (iv) next contacting each of the locating members 217, 218 of the moveable frame 216 to the at least one resilient member 206, 208; and (v) then separately moving, relative to the moveable frame 216, the at least one separately moveable cleaning member 212, 214 into cleaning contact with the moving belt photoreceptor 10, thereby minimizing cleaning apparatus induced motion quality disturbances in the moving belt photoreceptor. The positioning step preferably comprises positioning a backer bar 202, 204 against the backside 13 of the moving belt photoreceptor 10, and at least one resilient or spring loaded member 206, 208 to each side of the moving belt photoreceptor 10. The backer bar 202, 204 is mounted for effectively supporting a backside 13 of the moving belt photoreceptor 10 during cleaning, and as such preferably extends from one side to the other thereof.

The mounting step comprises mounting at the cleaning station LL, a cleaning apparatus that includes at least one moveable cleaning member or brush 212, 214, and the moveable frame 216 supporting the at least one cleaning brush. The providing step as shown preferably comprises providing at least a pair of backer bars 202, 204 and a pair of resilient or spring loaded members 206, 208 on each side of the belt photoreceptor 10 (only one side of the belt is visible from the drawings). The cleaning apparatus thus also includes a pair of separately moveable cleaning brushes 212, 214.

For carrying out the method of the present invention, a motion-defect-free cleaning assembly 200 is provided. As illustrated, the motion-defect-free cleaning assembly 200 includes at least one, and preferably a plurality of backer bars 202, 204 for effectively supporting the backside 13 of the moving belt photoreceptor 10 during cleaning, and at least one, preferably a plurality of resilient members 206, 208 positioned to each side of the moving belt photoreceptor 10 at the desired belt cleaning station LL. The motion-defect-free cleaning assembly 200 also includes a cleaning apparatus 210 mounted to the frame of the machine at the desired belt cleaning station LL for cleaning the image carrying surface of the belt photoreceptor 10.

The cleaning apparatus 210 includes at least one separately moveable cleaning member, for example, cleaning brushes 212, 214, and the moveable frame 216 which in turn supports the cleaning brushes, a plurality of locating members 217, 218 for first contacting and locating against the resilient members 206, 208 prior to the cleaning brushes 212, 214 contacting and engagingly cleaning a portion of the surface 11 of the moving belt photoreceptor 10. As described above, each of the resilient members 206, 208 comprises a spring member. As described above, the motion-defect-free assembly 200 includes a drive and control system (including the ESS 80) for first moving the moveable frame 216 into contact with each of the locating members 217, 218 and for then separately moving, relative to the moveable frame 216, the at least one separately moveable cleaning member 212, 214 into contact and cleaning engagement with the moving belt photoreceptor 10, thereby minimizing cleaning apparatus induced motion quality disturbances in the moving belt photoreceptor.

When the cleaning assembly 200 is properly located for re-engagement with the moving belt photoreceptor, only the fibers of the cleaning members or brushes 212, 214 actually contact the photoreceptor, and only after the mass and kinetic energy of the moving cleaning apparatus frame had already been absorbed by the resilient or spring loaded members 206, 208. The only motion related forces impacting the moving belt photoreceptor 10 from such contact and re-engagement, come from deflection of the brush fibers of the brushes 212, 214. This is fairly straight forward and cost effective, and importantly minimizes motion quality impacts and defects significantly.

Depending on the locational accuracy specified, pins 220 and locating holes 222 can be used or spring loaded members can be added to the moveable frame 216 of the cleaning apparatus 210. By first locating the cleaning apparatus frame or moveable frame 216 to resilient members 206, 208 of the machine frame, and then contacting the moving belt photoreceptor 10 only with the fibers of the brushes 212, 214, the result is an absolute minimum possible motion quality impact.

The cleaning apparatus 210 is located via the two locating pins 220, and holes or slots 220 in a back plate 224 on the inboard (IB) side, and two similar locating pins, and holes or slots on the outboard (OB) side. These locating holes or slots 220, IB and OB, preferably are held within 0.35 mm, relative to machine datum. The locating pins 220, and OB, which are preferably on the back plate 224, similarly are held within 0.07 mm TP relative to the center of a donor roll within the cleaning apparatus moveable frame or housing 216.

Each brush 212, 214 will be held within 0.07 mm relative to a brush arm pivot (not shown), and a cam follower (not shown) for the brushes will be held within 0.07 mm, relative to the brush arm pivot. The donor roll which travels with the brushes will similarly be held within 0.07 mm relative to the-brush arm pivot, as well as will a camshaft for the cam follower by the brushes. Four cleaning assembly set screws (not shown) are provided and are adjustable to +/−0.127 mm, relative to the brushes 212, 214. The backer bars 202, 204 themselves can be spring loaded against the cleaning assembly set screws.

As can be seen, there has been provided a motion-defect-free assembly and a method of minimizing cleaning apparatus induced motion quality disturbances in a moving belt photoreceptor of a toner image reproduction machine are provided. The assembly for practicing the method includes at least one resilient member located to each side of the moving belt photoreceptor at a desired belt cleaning station along a path of movement of the belt photoreceptor, and a cleaning apparatus that is mounted at the cleaning station and that includes at least one separately moveable cleaning member. The cleaning apparatus also includes a moveable frame having frame locating members, and the at least one separately moveable cleaning member. The motion-defect-free assembly also includes a drive and control system for first moving the moveable frame into contact with each of the locating members and for then separately moving, relative to the moveable frame, the at least one separately moveable cleaning member into contact and cleaning engagement with the moving belt photoreceptor, thereby minimizing cleaning apparatus induced motion quality disturbances in the moving belt photoreceptor.

While the invention has been described with reference to the structure herein disclosed, it is not confined to the details as set forth and is intended to cover any modification and changes that may come within the scope of the following claims.

What is claimed:

1. A method of minimizing cleaning apparatus induced motion quality disturbances in a moving belt photoreceptor of a toner image reproduction machine, the method comprising the steps of:

a. providing at a desired belt cleaning station, a resilient member behind and to each side of the moving belt photoreceptor;

b. mounting at the cleaning. station, a cleaning apparatus including at least one separately moveable cleaning member, and a moveable frame having frame locating members and supporting the at least one separately moveable cleaning member;

c. first moving the moveable frame towards the moving belt photoreceptor and the resilient member to each side;

d. next contacting each of the locating members of the moveable frame to the resilient member; and e. then separately moving, relative to the moveable frame, the at least one separately moveable cleaning member into cleaning contact with the moving belt photoreceptor, thereby minimizing cleaning apparatus induced motion quality disturbances in the moving belt photoreceptor.

2. The method of claim 1, where said providing step comprises positioning at least one spring loaded backer bar behind and to each side of the moving belt photoreceptor at a belt cleaning station along a path of movement of the moving belt photoreceptor.

3. The method of claim 1, where said at least one moveable cleaning member comprises a cleaning brush supported by a moveable frame.

4. The method of claim 1, wherein said providing steps comprises providing at least one spring loaded backer bar supporting a backside of the moving belt photoreceptor and extending to each side thereof.

5. The method of claim 1, wherein said providing step comprises providing at least a pair of spring loaded backer bars supporting a backside of the moving belt photoreceptor, and each spring loaded backer bar extending to each side of the moving belt photoreceptor.

6. The method of claim 5, wherein said at least one moveable cleaning member comprises a pair of separately moveable cleaning brushes.

7. A cleaning assembly for minimizing cleaning apparatus induced motion quality disturbances in a moving belt photoreceptor of a toner image reproduction machine, the cleaning assembly comprising:

a. a plurality of resilient members positioned behind and to each side of the moving belt photoreceptor at a desired belt cleaning station; and b. a cleaning apparatus mounted to a frame of the machine at the desired belt cleaning station, said cleaning apparatus including:

(i) at least one separately moveable cleaning member, and (ii) a moveable cleaner frame supporting said cleaning member and having frame locating members for locating against said resilient members prior to said cleaning member contacting and cleaning a portion of a surface of said moving belt photoreceptor.

8. The cleaner assembly of claim 7, wherein each said resilient member comprises a spring loaded backer bar supporting a backside of the moving belt photoreceptor, and extending to each side the moving belt photoreceptor.

9. The cleaner assembly of claim 7, wherein said cleaning member comprises a fibrous cleaning brush.

10. A multipass color electrostatographic reproduction machine for producing color toner images without cleaning apparatus motion related image defects, the color electrostatographic reproduction machine comprising:

(a) a machine frame;

(b) a moving belt photoreceptor mounted to said machine frame and having an image bearing surface;

(c) means for forming toner images electrostatically on said image bearing surface;

(d) means for transferring the toner images from said image bearing surface onto a receiving substrate; and (e) a cleaning assembly for minimizing cleaning apparatus induced motion quality disturbances in said moving belt photoreceptor, said cleaning assembly comprising:

(i) a plurality of resilient members positioned to each side of said moving belt photoreceptor and at a desired belt cleaning station; and (ii) a cleaning apparatus mounted to said machine frame at the desired belt cleaning station, said cleaning apparatus including at least one separately moveable cleaning member, and a moveable cleaner frame supporting said cleaning member and having locating members for locating against said resilient members prior to said cleaning member contacting and cleaning a portion said image bearing surface of said moving belt photoreceptor.

* * * * *